United States Patent [19]

Ritter, Jr.

[11] 4,096,617

[45] Jun. 27, 1978

[54] AXLE PULLING MEANS

[75] Inventor: Arthur J. Ritter, Jr., Metamora, Ill.

[73] Assignee: Caterpillar Tractor Co., Peoria, Ill.

[21] Appl. No.: 800,822

[22] Filed: May 26, 1977

[51] Int. Cl.[2] ..... B25B 27/14

[52] U.S. Cl. ..... 29/278; 81/3 R

[58] Field of Search ..... 29/278, 280, 281, 283; 81/3 R; 403/343

[56] References Cited

U.S. PATENT DOCUMENTS

| | | | |
|---|---|---|---|
| 2,834,625 | 5/1958 | Stanley et al. | 403/343 |
| 3,462,147 | 8/1969 | Mancuso | 403/343 |
| 3,495,123 | 2/1970 | Raddatz | 403/343 |

*Primary Examiner*—James L. Jones, Jr.

*Attorney, Agent, or Firm*—Wegner, Stellman, McCord, Wiles & Wood

[57] ABSTRACT

Structure for use in manipulating an axle such as during installation in and removal thereof from a vehicle drive assembly. The structure includes a construction at one end of the drive axle arranged to be received in a socket end portion of a puller tool. The axle end construction and the socket configuration are coordinated so as to provide a snug fitted association therebetween when the puller tool is installed on the axle end. The axle end and puller tool define cooperating threaded surfaces for removably securing the puller tool to the axle end and additional support surfaces are provided to provide a positive surface engagement between the puller tool and axle end for positive control of the axle during the installation and removal operations. A limit surface is provided for indicating the fitted association of the puller tool to the axle end. The puller tool may include an elongated outer handle portion for facilitated manipulation of the axle secured to the inner end of the tool in cantilevered fashion.

4 Claims, 5 Drawing Figures

FIG. 1
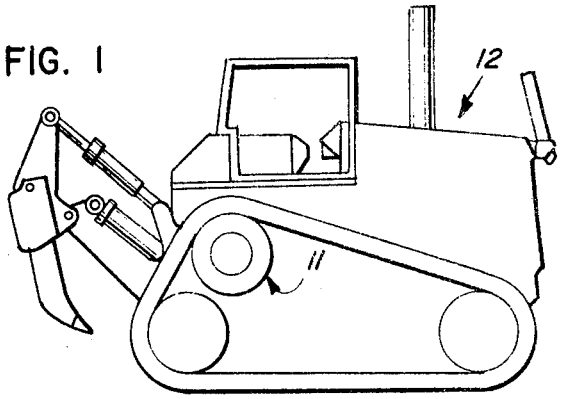
FIG. 2
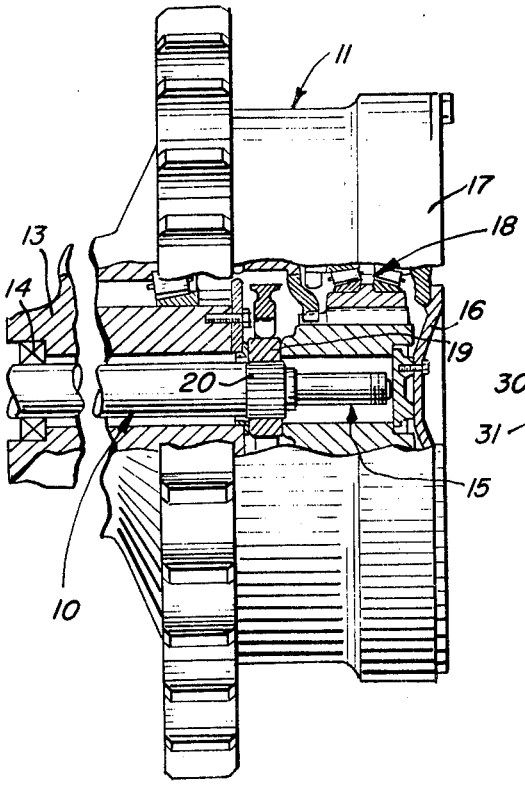
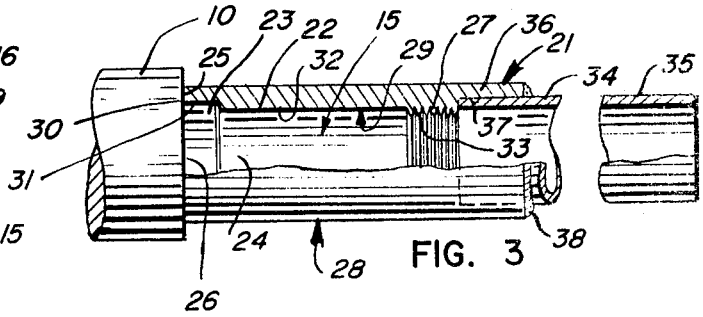
FIG. 3
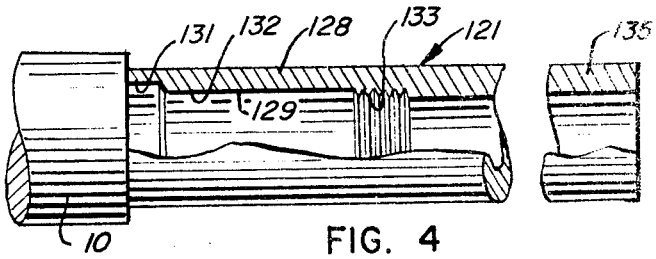
FIG. 4
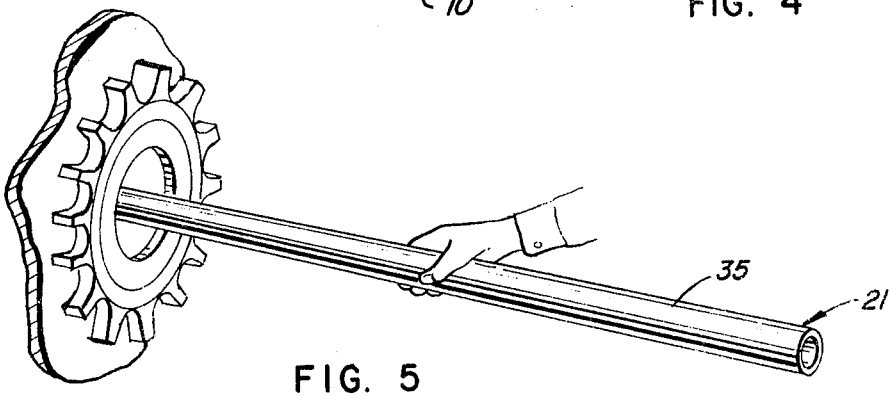
FIG. 5

AXLE PULLING MEANS

BACKGROUND OF THE INVENTION

1. Field of the Invention

This invention relates to drive servicing structures and in particular to means for manipulating the axle of a vehicle drive assembly such as in the servicing thereof.

2. Description of the Prior Art

In one conventional form of vehicle, such as a tractor vehicle, a drive shaft, or axle, is provide which, from time to time, may require removal from the drive assembly. Similarly, replacement of the drive shaft, or substitution therefor, requires the insertion of the drive shaft into the drive assembly. As the drive shaft may be relatively heavy, suitable manipulation thereof during such removal or installation operation requires a positive support of the axle. As the support of the axle during such operations is conventionally required to be from one end of the axle, substantial problems arise in the holding of the axle.

It has been conventional to provide wheel pullers and the like for use in removing wheels from vehicle mounting means and a wide variety of different wheel pullers have been developed in the art.

SUMMARY OF THE INVENTION

The present invention comprehends an improved structure for use in manipulating an axle such as during installation in and removal from a vehicle drive assembly which provides a positive holding of the end of the axle during such operations.

More specifically, the invention comprehends the provision of such structure including means at one end of the axle defining a cylindrical support surface, an annular boss at the inner end of the support surface, a radial outwardly facing limit surface at the inner end of the boss, and a male threaded surface at the outer end of the support surface, and a puller tool having an inner end portion defining a socket for snugly receiving the end of the axle, the socket being defined by a distal end surface abutting the axle limit surface, an inner cylindrical portion snugly fitting the boss, an intermediate cylindrical portion snugly fitting the axle support surface, and a female threaded portion threaded to the axle male threaded surface, and an elongated outer end portion defining a manipulating handle.

In one form of the invention, the inner end portion of the puller tool is defined by a unitary element secured to the inner end of the elongated outer handle portion. The element may be welded to the inner end of the handle portion and further, may define a socket into which the inner end of the handle portion is inserted prior to the welding thereof.

In another form of the invention, the inner end portion and the outer handle portion of the puller tool may comprise a unitary element.

Illustratively, the unitary element may comprise a tubular element having a machined inner end portion defining the inner end socket for receiving the outer end of the axle.

The manipulating structure of the present invention is extremely simple and economical of construction while yet providing an improved axle manipulating means as discussed above.

BRIEF DESCRIPTION OF THE DRAWING

Other features and advantages of the invention will be apparent from the following description taken in connection with the accompanying drawing wherein:

FIG. 1 is a side elevation of a vehicle having a drive assembly provided with a drive axle adapted to be utilized in the structure of the present invention;

FIG. 2 is a fragmentary elevation of the drive assembly having a portion broken away to illustrate the arrangement of the drive axle therein;

FIG. 3 is a fragmentary elevation illustrating the attachment of one form of puller tool with the outer end of the drive axle;

FIG. 4 is a fragmentary elevation with portions broken away illustrating another form of puller tool for use in association with the drive axle; and FIG. 5 is a perspective view illustrating the use of the puller tool in manipulating the drive axle.

DESCRIPTION OF THE PREFERRED EMBODIMENT

In the exemplary embodiment of the invention as disclosed in the drawing, a drive axle generally designated 10 is provided in a drive assembly, such as drive assembly 11, of a vehicle generally designated 12 which, as illustrated in FIG. 1, may comprise a track-type vehicle, or tractor. Vehicle 12 is illustrative only, it being understood that the present invention is directed to the problem of removing and installing an axle or other shaft of any of a wide range of different apparatuses.

As shown in FIG. 2, the axle may be rotatably mounted to a support 13 by suitable bearings 14. Access to an outer end generally designated 15 of the axle may be provided by a removable cover 16 of a housing 17 such as for enclosing a final drive gear assembly 18. The drive assembly may include a first sun gear 19 splined to a spline portion 20 of the axle.

The present invention, as indicated briefly above, is directed to the problem of removing and installing the drive shaft 10 in such a drive assembly. As the drive shaft may be relatively heavy and elongated, a positive, firm support of the drive shaft is required for optimum manipulation thereof during such removal and installation operations. The present invention comprehends an improved structure for use in such manipulation including a puller tool generally designated 21 cooperating with the end portion 15 of the axle in an improved manner to provide such highly desirable, positive and firm support of the axle during the manipulating operations.

More specifically, as seen in FIG. 3, the invention comprehends the provision on the axle outer end 15 of a cylindrical support surface 22, an annular boss 23 at the inner end 24 of the support surface 22, and a radial, outwardly facing limit surface 25 at the outer end 26 of the boss. The axle outer end further defines a male threaded surface 27 defining the distal inner end portion of the axle.

The puller tool 21 includes an inner end portion 28 defining a socket 29 snugly receiving the outer end of the axle.

More specifically, the socket is defined by a distal end surface 30 abutting the axle limit surface 25, an inner cylindrical portion 31 snugly receiving the boss 23 of the axle end, an intermediate cylindrical portion 32 snugly receiving the cylindrical support surface 22 of the axle end, and a female threaded portion 33 threaded to the male threaded portion 27 of the axle end.

In the preferred embodiment of the invention, inner end portion 28 of the puller tool comprises a tubular element which is secured to the inner end 34 of an outer handle portion 35 of the tool.

More specifically, the outer end 36 of the tool inner portion 28 defines an outwardly opening socket 37 snugly receiving the inner end 34 of the handle portion of the tool. The distal end of portion 36 may be secured to the handle portion 35 at the outer end of the recess, or socket, 37 by suitable means, such as weld 38.

As shown in FIG. 5, handle portion 35 of the tool 21 may be elongated so as to provide a positive support during the axle manipulating operations.

As a result of the positive and firm support of the axle by means of the puller tool, the axle may be readily installed and removed relative to the drive assembly by simple threaded connection of the puller tool to the end of the axle. As shown in FIG. 3, the snug fit of the inner end portion 28 of the puller tool with the outer end portion 15 of the axle provides a positive, firm support of the handle portion 35 of the tool to the axle end for facilitated manipulation of the axle during such operations.

Referring now more specifically to FIG. 4, a modified form of puller tool generally designated 121 is shown to comprise a unitary tubular element wherein the handle portion 135 is formed integrally with the inner end connector portion 128. The socket 129 of puller tool 121 is suitably machined in the inner end portion 128 of the tubular element to define the cylindrical surfaces 131 and 132, and the female threaded surface 133.

The use of puller tool 121 is similar to the use of puller tool 21 in manipulating the axle 10.

The puller tool may be formed of a suitable strong material, such as steel, and the cooperating surfaces of the axle end and puller tool may be suitably machined therein to provide the desired snug fit discussed above. As the puller tool is readily threaded to the axle end, the tool may be readily connected to the axle end by simple insertion thereof through the cover 17 as discussed above. As the length of the handle portion 35 is relatively large, facilitated leverage of the axle is provided for facilitated manipulation thereof during the removal and installation operations.

The foregoing disclosure of specific embodiments is illustrative of the broad inventive concepts comprehended by the invention.

The embodiments of the invention in which an exclusive property or privilege is claimed are as follows:

1. Structure for use in manipulating a heavy axle such as during installation in and removal from a vehicle drive assembly, said axle manipulating structure comprising:

means at one end of said drive axle defining a cylindrical support surface, an annular boss at the inner end of said support surface, a radial outwardly facing limit surface at the inner end of said boss, and a male threaded surface at the outer end of said support surface; and a puller tool having an inner end portion defining a socket for snugly receiving said end of the axle, said socket being defined by a distal end surface abutting said axle limit surface, an inner cylindrical portion snugly fitting said boss, an inner-intermediate cylindrical portion snugly fitting said axle support surface, and an outer-intermediate female threaded portion threaded to said axle male threaded surface, said puller tool further having an elongated outer end portion defining a manipulating handle, the length of said inner-intermediate cylindrical portion being at least three times greater than the length of said outer intermediate female threaded portion, said inner cylindrical portion and inner-intermediate cylindrical portion defining support surfaces providing positive surface engagement between the puller tool and the axle end for positive control of the heavy axle during installation and removal operations.

2. The axle manipulating structure of claim 1 wherein said inner end portion of the puller tool comprises a unitary element secured to the inner end of the elongated outer handle portion.

3. The axle manipulating structure of claim 1 wherein said outer handle portion comprises a tubular portion.

4. The structure for use in manipulating the heavy axle of claim 1 wherein said inner-intermediate cylindrical portion is at least four times greater than the length of said socket.

* * * * *